US006656065B2

(12) United States Patent
Nye

(10) Patent No.: US 6,656,065 B2
(45) Date of Patent: Dec. 2, 2003

(54) WHEEL MOUNTED ADJUSTABLE ROLLER SUPPORT ASSEMBLY FOR A BASKETBALL GOAL SYSTEM

(75) Inventor: S. Curtis Nye, South Ogden, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/050,612

(22) Filed: Jan. 16, 2002

(65) Prior Publication Data

US 2003/0134701 A1 Jul. 17, 2003

(51) Int. Cl.[7] ..... A63B 63/08

(52) U.S. Cl. ..... 473/481; 473/415; 254/9 R

(58) Field of Search ..... 473/481, 433, 473/415, 436, 472, 479; 254/9 R; 280/43.17; 16/34, 33, 32

(56) References Cited

U.S. PATENT DOCUMENTS 165,965 A * 7/1875 West ..... 280/43.14
3,602,504 A 8/1971 Chapman et al.
3,650,530 A 3/1972 Gantz
3,669,450 A * 6/1972 Mason ..... 473/483
3,716,234 A 2/1973 Lancellotti
3,841,631 A 10/1974 Dolan
3,999,753 A 12/1976 Desilets et al.
4,412,679 A 11/1983 Mahoney et al.
4,417,738 A 11/1983 Kendall
4,526,367 A 7/1985 Haston et al.
4,759,545 A 7/1988 Grable
4,762,331 A 8/1988 Tucker et al.
4,828,208 A 5/1989 Peterson et al.
4,940,232 A 7/1990 Chen
5,014,983 A 5/1991 Saunders
5,039,109 A 8/1991 Mahoney et al.
5,112,407 A 5/1992 Sakai et al.
5,114,164 A 5/1992 Bothwell et al.
5,158,319 A 10/1992 Norcia et al.
5,193,828 A 3/1993 Benvenuti
5,207,407 A 5/1993 Fitzsimmons et al.
5,220,740 A 6/1993 Brault
5,248,140 A 9/1993 Matherne et al.
5,249,438 A 10/1993 Rhaney et al.
5,259,612 A 11/1993 Matherne et al.
5,308,302 A 5/1994 Miller
5,313,817 A 5/1994 Meinders
5,348,326 A 9/1994 Fullenkamp et al.
5,354,049 A 10/1994 Matherne et al.
5,377,976 A 1/1995 Matherne et al.
5,390,914 A 2/1995 Schroeder
5,415,393 A 5/1995 Fitzsimmons et al.
5,478,068 A 12/1995 Schroeder
5,518,233 A 5/1996 Williams
5,542,679 A 8/1996 Caso
5,571,229 A 11/1996 Fitzsimmons et al.
5,573,237 A 11/1996 Van Nimwegen et al.
5,615,451 A 4/1997 Peterson et al.
5,632,480 A 5/1997 Davis et al.
5,667,230 A 9/1997 Riley et al.
5,672,130 A 9/1997 O'Connell et al.

(List continued on next page.)

*Primary Examiner*—Paul T. Sewell
*Assistant Examiner*—M. Chambers
(74) *Attorney, Agent, or Firm*—Workman Nydegger

(57) ABSTRACT

A basketball goals system providing a high degree of portability is disclosed. The goal system has a pole, a base member, and an adjustable wheel assembly. The adjustable wheel assembly is attached to the base member and transitions a set of wheels in contact or out of contact with the playing surface. The wheels of the adjustable wheel assembly are placed in contact with the playing surface by pivoting a cam on the axle of the wheels. The cam pushes upward on a portion of the base member, such that the base member is supported on the wheels. Once the base member is supported on the wheels, it may be easily transported to the desired location. The cam may be operated by an adjustment member that is coupled to the cam, such as a lever.

39 Claims, 4 Drawing Sheets

U.S. PATENT DOCUMENTS 5,709,397 A 1/1998 Hall
5,716,186 A 2/1998 Jensen et al.
5,730,668 A 3/1998 Hege et al.
5,758,752 A 6/1998 King et al.
5,772,167 A 6/1998 Koole
5,775,650 A 7/1998 Fox
5,800,291 A 9/1998 Grover
5,807,195 A 9/1998 Westbrook
5,823,550 A 10/1998 Bennett et al.
5,836,838 A 11/1998 Van Nimwegen et al.
5,865,691 A 2/1999 Chen
5,899,467 A 5/1999 Henkel
5,902,197 A 5/1999 Davis et al.
5,916,047 A 6/1999 Schickert et al.
5,944,291 A 8/1999 Kato et al.
5,947,848 A 9/1999 Koole
5,983,602 A 11/1999 Allen et al.
6,001,034 A 12/1999 Schickert et al.
6,027,418 A 2/2000 van Nimwegen et al.
6,053,825 A 4/2000 Allen et al.
6,089,666 A 7/2000 Rosko
6,117,027 A 9/2000 Davis et al.
6,179,733 B1 1/2001 Story
6,338,686 B1 1/2002 King
6,427,963 B1 * 8/2002 Davis et al. ..... 248/519
6,432,003 B1 * 8/2002 Van Nimwegen ..... 473/481

* cited by examiner

WHEEL MOUNTED ADJUSTABLE ROLLER SUPPORT ASSEMBLY FOR A BASKETBALL GOAL SYSTEM

BACKGROUND OF THE INVENTION

1. Field of the Invention

The present invention relates portable basketball goal systems. More specifically, the present invention relates to an apparatus for selectively engaging wheels to a surface to transport a portable goal system.

2. Description of Related Art

The game of basketball has become a popular sport in the United States and throughout the world. The number of professional and recreational basketball players has steadily increased through the past several decades. Unfortunately, in previous years, playing basketball has been limited to gymnasiums and outdoor courts, where expensive basketball equipment was available. However, as the popularity of the sport increased even more, the demand for access to basketball courts has increased.

For many players, the desire for basketball playing facilities has led to an increase desire for home basketball goal systems installed near a drive way or other playing surfaces. Home basketball goal systems typically are comprised of a backboard fastened to a wall, such as a garage, or fastened to a large metal pole anchored in the ground.

Unfortunately, installation of these basketball goal systems is difficult and obtrusive. For example, fixing a basketball goal to a wall often involves reinforcing that wall as well as making large holes in the wall to place the supporting fasteners. Often these walls are made of brick or stone which cannot be easily repaired when the basketball goal system is removed. Similarly problematic, a pole mounted basketball system involves digging a large hole adjacent to a playing surface, then filling that hole with cement while maintaining the pole in a vertical orientation.

Because of the amount of work and cost of obtaining a home basketball system, many potential players were unable to obtain easy access to a basketball goal system. Thus, only a selective ambitious few were able to play the sport of basketball at home. However, recent acknowledgment of these problems has produced a new line of freestanding basketball goal systems that are easy to install and relatively inexpensive.

Freestanding and portable goal systems are typically purchased in kit form and can be installed without mounting the system to a wall or into the ground. Instead, the freestanding goal systems are self supporting and can be assembled by a person having minimal mechanical skills. Typically, portable basketball goal systems comprise a base member, a pole, and a goal system. The base member is generally weighted to provide stability and support for the pole and goal system.

In efforts to increase the shipability and portability of the basketball goal systems, fillable ballast systems that receive a large massive water or sand to provide a weighted base were introduced. The water and sand ballast systems allow the base to be inexpensively shipped and easily transported. Furthermore, once the system was assembled at the home, the user could position the basketball goal system to any location in the yard and then fill the ballast system.

Unfortunately, these systems are only portable to the extent that they may be positioned to any location in yard when first assembled. Once the ballast is filled, the portable goal system becomes very difficult to move. Thus, portability within the yard or home playing surface is not as practical. In order for the player to move the goal system once the system is set up, the entire ballast must be emptied and then refilled when moved to the desired location. Such limitations have prevented true portability for home basketball systems.

A highly portable home basketball goal system may have many applications and uses for the everyday basketball player. For example, playing basketball in the morning and evening may often involve the sun hindering the view of the goal during one of the times. Players may desire to position that goal in one location for the morning at another location for the evening. However, players may be unwilling to go to extreme efforts to accomplish this.

Additionally, players may wish to move a basketball goal system to avoid temporary obstacles in the playing surface, such as a wet driveway or a parked car. Other basketball goal systems may need to be moved periodically for service or cleaning of the adjacent areas. For example, a basketball goals system positioned on grass may need to be moved periodically to cut the grass around the system as well as to provide the grass under the base member with sun and water.

Furthermore, some basketball players may not be inclined to have an entire goal system constantly located in their yard. It may be desired for the system to be placed in a garage or other storage area overnight, during poor weather, for the winter, or when entertaining guests. Unfortunately, the chore of breaking down the basketball system and emptying the ballasts to transport the basketball goal system is typically too burdensome for most people. As a result, basketball systems often remain in yards and driveways for months, while not being used.

To provide increased portability for some basketball systems, wheels have been introduced at the edges of a base. These wheels are often fixed to the base member and engage the playing surface when the entire basketball goal system is tilted back and the player balances the long pole during transportation. Unfortunately, these fixed wheel systems are difficult to use and have made little practical change with the portability problem.

Often the ballast of the base member contains 40 to 50 gallons of water or sand. The associated weight makes it very difficult to tilt back the goal system and maneuver the base to the desired location. Furthermore, the use of the pole as a lever arm to tilt the base, creates a high level of stress on the pole and also presents the possibility of the goal system falling and damaging the goal or injuring the player. Because of these and other shortcomings, basketball goal systems providing simple and rapid portability are not presently available.

Therefore, there is a need in the art for a portable basketball goal system that may be easily transported with minimal operations by the user. Such a system would be preferably inexpensive and provide simple user controls and adjustments.

SUMMARY OF THE INVENTION

The apparatus of the present invention has been developed in response to the present state of the art, and in particular, in response to the problems and needs in the art that have not yet been fully solved by currently available basketball goal systems. Thus, it is an overall objective of the present invention to provide a portable basketball goal system that may be transported with minimal effort by the user.

The portable basketball goal system comprises a pole, a base member, an adjustable wheel assembly, and an adjustment assembly. The pole is configured to support a basketball goal above a playing surface and the base member is configured to support the pole in a generally upward direction. The pole may be any number of cross-sectional shapes and configurations. The adjustable wheel assembly attaches to the base member, such that the wheel assembly can transition between a supported position and an unsupported position. In the supported position the wheel assembly selectively engages the playing surface. In the unsupported position the base member selectively rests on the playing surface.

The adjustable wheel assembly can transition between the supported and unsupported position by an adustment assembly. The adjustable wheel assembly transitions between the positions by the adjustment assembly comprised of a cam pivotally connected to the wheel assembly and an adjustment member to pivot the cam. The cam is configured to raise the base member relative to the axle as the cam pivots. As the base member elevates off of the playing surface the wheels become in supported contact with the playing surface. Once the wheels are in a supported position with the playing surface, the basketball goal system may be moved to various locations on the playing surface or in storage locations.

The cam of the adjustment assembly may pivot on the same axle as the wheels of the adjustable wheel assembly. The adjustment assembly may further comprise a second cam that is coaxial to the first cam. The additional cam or cams may be present to provide more contact area between the cam and the base member. The base member may also have a follower member that the cam contacts as the cam transitions with the base member between the lowered position and the elevated position. The follower may have varying shapes that provide the cam with a contact location to control the motion of the base member.

The cam may also have varying geometries to control the operational characteristics. In one implementation, the cam may have a stop that selectively engages the base member. The stop may prevent the cam from over rotating, such that the adjustment member does not contact the playing surface or the pole. Additionally, the cam may have multiple stable positions that allow the adjustment mechanism to snap to two or more positions. The two positions may correspond to the supported and unsupported positions of the wheel assembly or the elevated and lowered position of the base member.

The adjustable wheel assembly may also comprise a clevis. The clevis may be positioned under the base member, such that the axle of the wheels and the cam is coupled to the clevis. The clevis may be pivotally attached to the base member. The pivotal attachment allows the wheels to turn relative to the base member, allowing the portable basketball system to be steered around the playing surface. Furthermore, the adjustment member may be rigidly attached to the adjustable wheel assembly to control the pivoting of the clevis.

The adjustment member may be a lever having a handle position at one end to provide a gripping location while moving the portable basketball goals system. Alternatively, the adjustment member may be a foot pedal that transitions the adjustable wheel assembly from the unsupported position to the supported position.

The basketball goal system may also comprise a second set of wheels positioned at an opposing end of the base member. The second set of wheels may be fixed relative to the base member. The second set of wheels may further be in partial contact with the playing surface. As the adjustable wheel assembly transitions to the supported position, the elevation of the base member will cause the second set of wheels to also come in contact with the playing surface.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above recited and other advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the Figures herein, could be arranged and designed in a wide variety of different configurations. Thus, the following more detailed description of the embodiments of the apparatus, system, and method of the present invention, as represented in FIGS. 1 through 4, is not intended to limit the scope of the invention, as claimed, but is merely representative of presently preferred embodiments of the invention.

Figure 1:
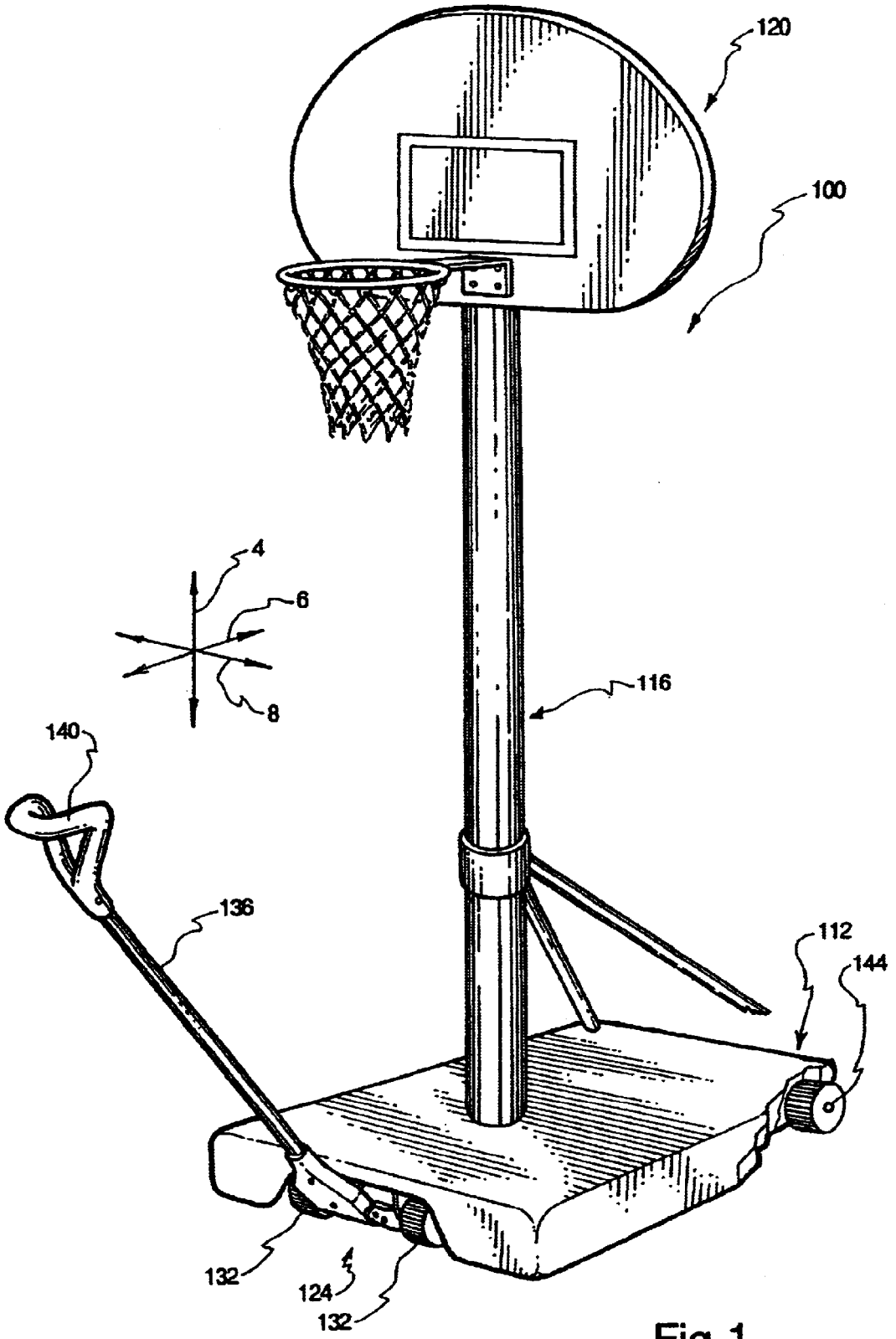
FIG. 1 is a perspective view of a basketball goal system having a cut out section.

Referring now to FIG. 1, a perspective view of a basketball goal system 100 is illustrated. The basketball goal system 100 is generally comprised of a base member 112, a pole 116 or other supporting structure, and a basketball assembly goal 120. To overcome the problems associated with previous basketball goal systems 100, the present basketball goal system incorporates an adjustable wheel assembly 124.

The adjustable wheel assembly 124 provides a mechanism whereby the base member 112 may be raised up and down in the vertical direction 4 to enable transport of the system 100. The base member 112 has a lowered position and an elevated position. In the lowered position, the base member 112 is substantially in contact with the playing surface 128. The playing surface 128 may be a basketball court made of any number of materials, such as wood, cement, asphalt, etc. Furthermore, the playing surface 128 may also include surfaces adjacent to the surface on which the game is played, such as grass or dirt.

The wheel assembly 124 provides a mechanism for transitioning the base member 112 from the lowered position to the elevated position. The wheel assembly 124 may comprise one or more wheels 132 that are selectively in contact with the playing surface 128. The transition of the wheel assembly 124 from the lowered position to the elevated position may be operated by a lever 136. The lever 136 may provide a method of using mechanical advantage from the length of the lever 136 to pivot about the wheels 132.

The operation of lever 136 may be further assisted by the presence of a handle 140 disposed at the end of the lever 136 opposite the wheel assembly 124. The handle 140 may provide a convenient location for grasping the lever 136 and controlling the movement of the basketball goal system 100.

Once the base member 112 is in the elevated position, the lever 136 may be used to pull or push the basketball goal system 100 to a desired location or orientation. It may be preferred for the lever 136 to be a relatively strong rigid member, sufficient to maintain large tensile and compressive forces. This increased strength requirement is important where the lever 136 and the handle 140 are used to drive and pull the basketball goal assembly 100.

The movement of the basketball goal system 100, may require the lever 136 to be pushed in order to drive the basketball goal system 100. In some situations in which the lever 136 is used to push the base member 112, the handle 140 may provide a convenient and ergonomic location from which the user may apply the pushing force. Additionally, the handle 140 may provide a member that is easy to grab while pulling on the lever 136 to move the basketball goal system 100.

The base member 112 may also comprise a second set of wheels 144, as can be seen in the cut out section of FIG. 1. The second set of wheels 144 may or may not be adjustable relative to the playing surface 128. In one application, it may be preferable for the second set of wheels 144 to maintain contact with the playing surface 128, even when in the lowered position. However, while in the lowered position a substantial portion of the base member 112 will be resting on the playing surface 128, despite the presence of the second set of wheels 144. Such an application may be preferred because of the increased cost associated with a second adjustable wheel assembly. However, if desired, the second set of wheels 144 may be adjustable.

Alternatively, the second set of wheels 144 may not be in contact with the playing surface 128 when the base member 112 is in the lowered position and the adjustable wheel assembly 124 is in the unsupported position. Rather, the second set of wheels 144 will come into contact with the playing surface 128 as the adjustable wheel assembly 124 transitions from the unsupported position to the supported position.

The second set of wheels 144 cooperate with the wheels 132 of the adjustable wheel assembly 124 to elevate a portion of the base member 112 above the playing surface 128. Once the base member 112 is elevated on the wheels 132, 144, the player may move or orient the basketball goal system 100 to the desired location and orientation. To assist in controlling the movement of the base member 112, the adjustable wheel assembly 124 may be pivotally attached to the base member 112.

The pivotal attachment to the base member 112 provides the basketball goal system 100 with steering capabilities. By having a rigid attachment of the lever 136 at the front of the base member 112, the adjustable wheel assembly 124 112 can be turned to guide the base member 112 in a fashion similar to pulling a wagon. The range of the pivotal motion will depend upon the structure and position of the adjustable wheel assembly 124 in relation to the base member 112. In one application, the adjustable wheel assembly 124 may have pivoting range up to about 90°. Other applications of the adjustable wheel assembly 124 may have pivoting range greater than about 90°. In yet another application, the pivoting range may be up to about 165°. Other ranges greater than 165° may be possible by controlling the structure of the base member 112.

Figure 2:
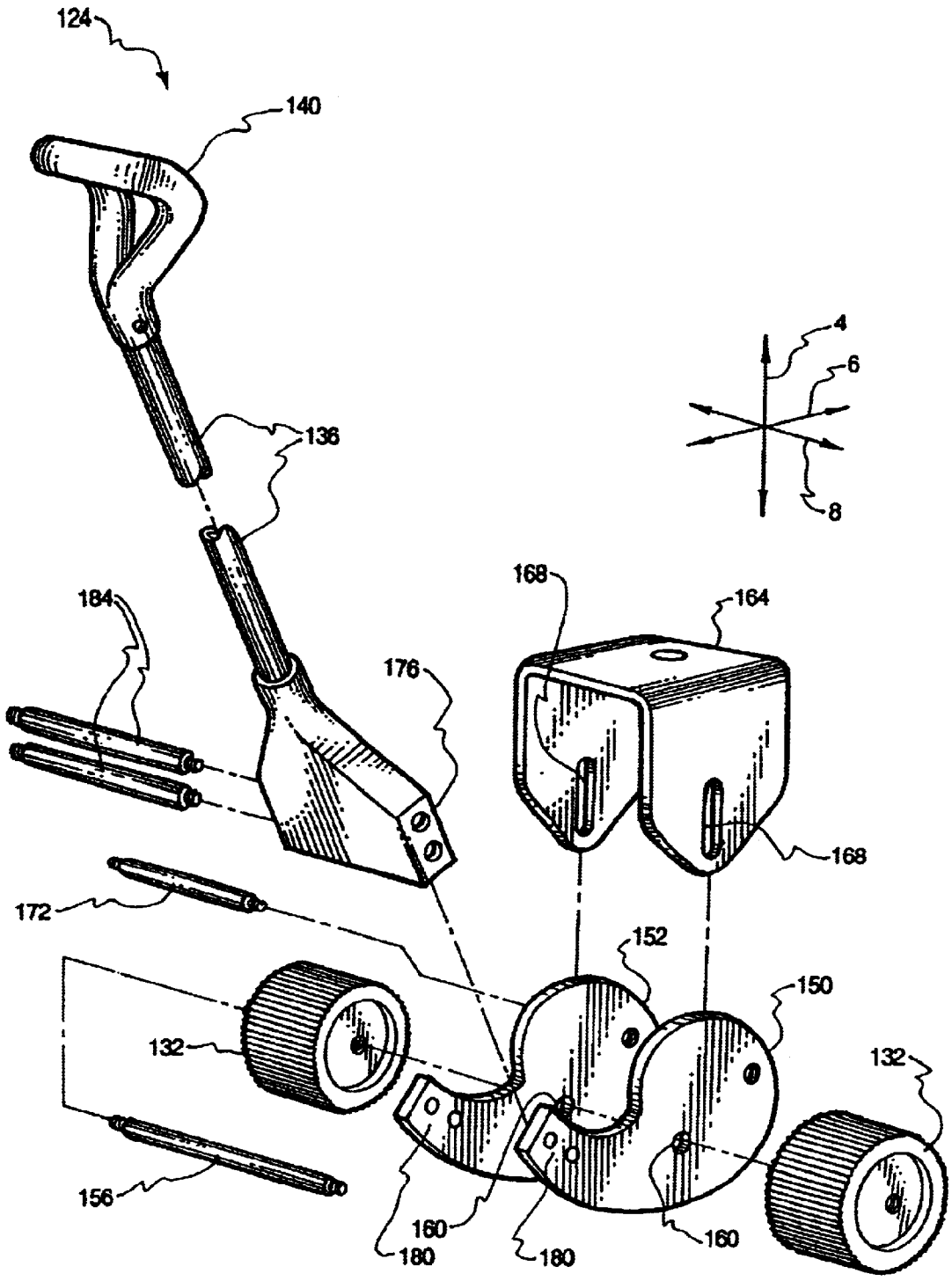
FIG. 2 is an exploded assembly view of an adjustable wheel assembly.

Referring now to FIG. 2, an exploded assembly view of an implementation of the adjustable wheel assembly 124 is illustrated. The adjustment of the wheels 132 of the adjustable wheel assembly 124 may be accomplished through one or more cams 150, 152. A first cam 150 and a second cam 152 may be pivotally mounted on the axle 156 of the wheels 132. In order to receive the axle 156, the first and second cams 150, 152 may have a pivoting hole 160. The pivoting holes 160 provide a location from which the cams 150, 152 may pivot relative to the wheels 132.

The cams 150, 152 and the wheels 132 may be situated within a clevis 164. The clevis 164 is a mounting structure configured to maintain an axle 156 and is often "U" shaped. The clevis has a plurality of slots 168 for receiving the axle 156, while the axle 156 is maintaining the wheels and the cams 150, 152. The slots 168 allow the axle 156 to be rotatably and slidably coupled to the clevis 164. The purpose for this slideable attachment of the axle 156 in the clevis 164 will become evident in the discussion of subsequent figures.

In one assembled embodiment, the first cam 150 and the second cam 152 are positioned within the clevis 164. The axle 156 is then placed through the slots 168 as well as through the pivoting holes 160. Once the cams 150, 152 are positioned within the clevis 164, the wheels 132 may be attached to the axle 156 on the outside of the clevis 164. The first cam 150 may be spaced at a distance from the second cam 152 by a spacing member 172. The spacing member 172 may simply be a rigid pin or other structure configured to hold the first cam 150 and the second cam 152 at a fixed distance. Multiple spacing members 172 may be used with the cams 150, 152 to reinforce the structure. Alternatively, the spacing member 172 may be a large solid member sandwiched between the cams 150, 152.

In general, the spacing member 172 allows the first cam 150 and the second cam 152 to function as a single member. However, the two cams 150, 152 may be replaced by a single cam of a determined thickness. The single cam would be positioned and operated in much the same fashion as the two cam 150, 152 configuration. Conversely, more than two cams may be employed as well.

The structure of the cams 150, 152 may also be reinforced by attaching the lever 136 or other adjustment member. The attachment end 176 may be position between the drive arms 180 of the two cams 150, 152. The width of the lever 136 would then provide a rigid spacing member to maintain the first cam 150 and the second cam 152 in a spaced relationship. The lever 136 may be attached to the cams 150, 152 through a number of fasteners 184 or other similar mechanisms.

While FIG. 2 illustrates one configuration of the adjustable wheel assembly 124, it is only one exemplary embodiment. Multiple variations of the adjustable wheel assembly 124 may be possible by varying one or more of the components. For example, the clevis 164 is simply one method of retaining the cams 150, 152 and the wheels 132. Structures performing the same function as the clevis 164 may be incorporated into the base member 112 as structural components of the based member 112, but not a separate mechanism.

Similarly, the adjustable wheel assembly 124 may include varying number of cams 150, 152. For example, a single cam 150 may be used in place of the first cam 150 and the second cam 152 or alternatively additional cams may be used with the first and second cams 150, 152. The cams 150, 152 may be various materials, including plastic or metal. Furthermore, the shape of the cams 150, 152 may vary depending upon the geometry of the clevis 164 and base member 112 as well as the desired operation of the cam 150, 152.

Figure 3:
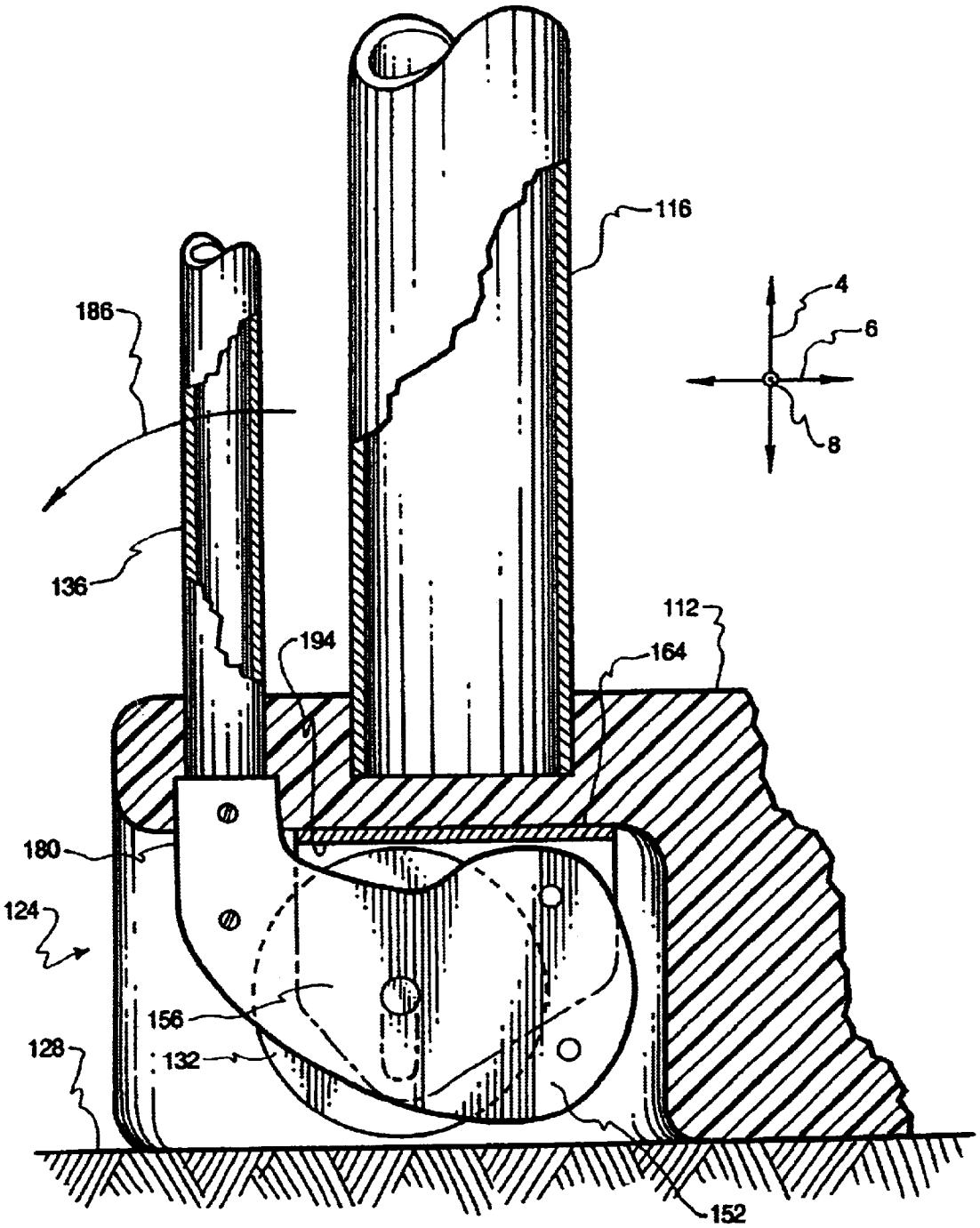
FIG. 3 is a cross-sectional view of an adjustable wheel assembly.

Referring now to FIG. 3, a cross-sectional view of the base member 112 and the adjustable wheel assembly 124 is illustrated. Portions of the pole 116, the lever 136, and the base member 112, where the base member is in the lowered position, are illustrated. In the lowered position, the base member 112 is in direct contact with the playing surface 128 or similar adjacent surfaces. When the base member 112 is in the lowered position, the wheel assembly 124 is in an unsupported position. In the unsupported position, the wheels 132 of the wheel assembly 124 may or may not be in contact with the playing surface 128.

While the wheels 132 may be in contact with the playing surface 128 when the base member 112 is in the lowered position, the wheels 132 and the wheel assembly 124 are not supporting the base member 112. In the lowered position, the frictional contact between the base member 112 and the playing surface 128 will maintain the basketball goal system 100 in a determined location. Thus, in some configurations the wheels 132 may be resting on the playing surface 128 but not in a supported position.

In the embodiment illustrated, the lever 136 is in a substantially vertical 4 position. The vertical 4 position of the lever 136 corresponds to the lowered position of the base member 112 and the unsupported position of the wheel assembly 124. However, the lever 136 may be positioned to correspond to any number of positions of the cam 152 and the base member 112. The position of the lever 136 may correspond to the configuration and various embodiments of the adjustable wheel assembly 124.

A function of the lever 136 in the present embodiment is to provide an actuation force or driving force for the cam 152. The lever 136 may be attached to the drive arm 180 of the cam. In the cam 152 of FIG. 3, the drive arm 180 provides a location where the cam 152 may be rotated about the axle 156. Thus, by applying a rotational force 184 to the lever 136, the cam 152 may be made to rotate.

However, the drive arm 180 may be positioned in various locations on the cam 152. For example, the drive arm 180 may not face the front of the basketball goal system 100, as shown. In one implementation, the drive arm 180 may be positioned to face towards the rear of the basketball goal system 100.

Alternatively, the drive arm 180 may not be the same layer of material as the other portions of the cam 152. The cam 152, as illustrated, is a single layer of material that may be cut out of a sheet of material having a desired thickness. However, the cam 152 may be made of several layers of material or of a three dimensional structure depending upon the needs of the embodiment. Thus, the drive arm 180 may be part of a second layer that is attached to a first layer of the cam 152.

Furthermore, a lever 136 may be attached to the cam 152 through various other mechanisms besides the drive arm 180. For example, the cam 152 may be rotated by an adjustment member pivotably coupled to the cam 152. The pivotal connection would be located at a distance offset from the axle 156, such that a vertical 4 motion of the adjustment member would produce a tangential force on the cam 152. A force on the cam 142 that is tangential to the axle 156 will produce a rotation in the cam 152. Because the adjustment member would be pivotally attached to the cam 152, the cam 152 could rotate relative to the adjustment member.

Additionally, the cam 152 could be rotated by fixedly coupling the cam 152 to the axle 156 and then applying rotational force to the axle 156. The rotational force on the axle 156 may be induced by a motor, crank, gear mechanism, or other similar device attached to the axle 156. Similarly, a lever 136 could be connected to the axle 156 whereby pivoting the lever 136 would rotate the axle 156. A rotational mechanism attached to the axle 156 could be implemented without requiring the need to reposition or adjust the wheels 132. The wheels 132 could be attached to the axle in a rotational fit where the diameter of the axle 156 is smaller than the corresponding holes in the wheels 132. Thus, the wheels 132 may rotate independently of the axle 156.

Alternatively, the cam 152 may not pivot on the same axle 156 as the wheels 132. In some applications, the wheels 132 and the cam 152 may be connected by a common structure, such that the cam 152 and the wheels 132 may move relative to the base member 112. For example, such a structure could be comprised of a clevis 164 having two axles, where the wheels 132 pivot on one axle and the cam 152 pivots on the other axle. However, providing the wheels 132 and the cam 152 with a common axle 156 can reduce the overall part count as well as the manufacturing costs of the basketball goal system 100.

While the present disclosure and the associated examples have illustrated the cam 152 as being rotated by a lever 136, other mechanisms may be employed to rotate the cam 152. For example, the drive arm 180 could be attached to a foot pedal or similar device where a downward force on the pedal could cause the cam 152 to rotate. The rotational force of the foot pedal could be applied to the drive arm 180, the axle 156, a pivotal attachment on the cam 152, or other mechanism. The foot pedal could be made to lock into two positions corresponding to the supported and unsupported positions. However, a lever 136 does provide a large degree of mechanical advantage with minimal structure. Also, a lever 136 provides a location where a user may control the basketball goal system 100 while pushing and pulling the system 100 to the desired location.

Numerous other methods of rotating a cam 152 may be employed in the adjustable wheel assembly 124. Similarly, multiple mechanisms for controlling the rotation of the cam 152 may also be employed without departing from the scope of the invention.

Figure 4:
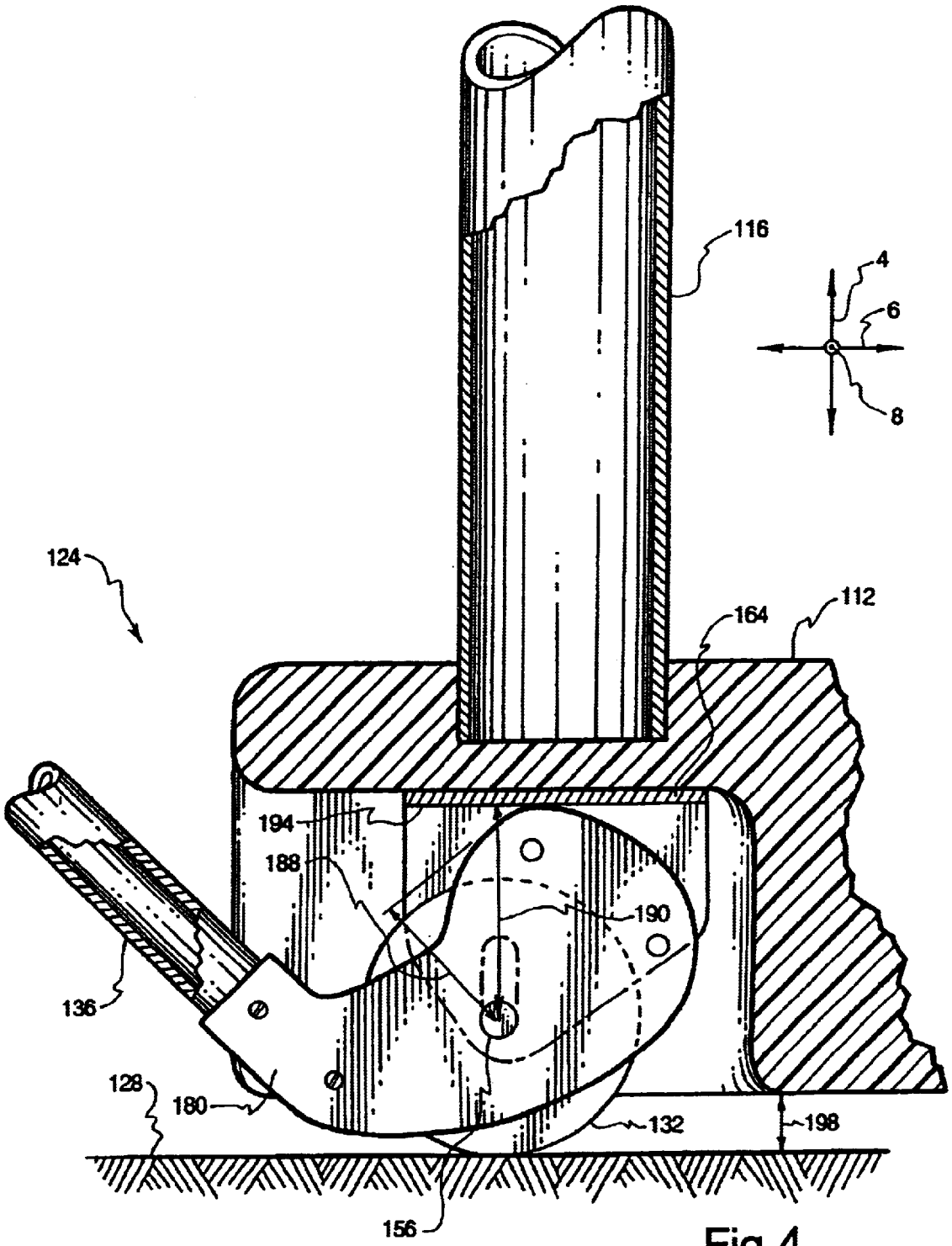
FIG. 4 is a cross-sectional view of an adjustable wheel assembly in another position.

Regardless of the mechanism employed, the operation of the cam 152 will transition the base member 112 from the lowered position to the elevated position. Referring now to FIG. 4, the cross-sectional view of the adjustable wheel assembly 124 is illustrated in the supported position. The supported position of the wheel assembly 124 is achieved by rotating the cam 152 about the axle 156.

The cam 152 elevates the base member 112 through the use of its geometric shape, having points at varying distances from the axle 156. In general, a cam 152 is a structure having edges that are at varying distances from a central, pivotal location. The edges at the varying locations drive a follower that is displaced according to the shape of the cam.

The cam 152 employed in the present adjustable wheel assembly 124 similarly employs a perimeter or edge that has different distances from the axle 156. To illustrate the function of the cam 152, two radiuses referenced from the axle 156 are provided, a first radius 188 and a second radius 190, as shown in FIG. 4.

The first radius 188 is the point on the cam 152 that is in contact with a surface 194 of the clevis 164 when the base member 112 is in the lowered position. In the present embodiment, the surface 194 of the clevis 164 functions as a follower for the cam 152. A follower can be described as a mechanism that responds to the rotation of a cam 152, such that the varying geometries of the cam 152 drive the follower.

While the follower in FIG. 4 is the surface 194 of the clevis 164, other members and devices may also function as a follower. For example, the cam 152 may be in direct contact with a portion of the base member 112, driving the base member vertically 4 as the cam 152 rotates. Alternatively, the follower may be a point or small structure on the clevis 164 or base member 112. The point or small structure would then be aligned to the cam 152, such that the geometry of the cam 152 would drive the follower. Furthermore, the follower may be a rigid structure that extends laterally 6 into contact with the cam 152.

Regardless of the type of follower used, the base member 112 will respond to the rotational motion of the cam 152 by traveling in a vertical 4 direction. In order for the base member 112 to obtain a vertical 4 motion relative to the wheels 132, the wheels 132 must be capable of sliding relative to the base member 112. In order to allow the wheels 132 to slide relative to the base member 112, the wheels 132 are slidably coupled to the clevis 164. The slidable attachment is achieved through slots 168 (shown in FIG. 2) in the clevis 164. The slots 168 allow the axle 156 to not only rotate within the slot 168, but also allows the axle 158 to slide vertically 4 relative to the clevis 164 and the base member 112.

The length of the slots 168 will depend upon the amount of travel required to elevate the base member 112. The distance that the base member 112 will be elevated above the playing surface 128 is the function of the difference between the lengths of the first radius 188 and the second radius 190. The elevated distance 198 in illustrated in FIG. 4 as the distance between the playing surface 128 and the base member 112.

In the embodiment illustrated in FIG. 4, the first radius 188 corresponds to the base member 112 being in the lowered position and the adjustable wheel assembly 124 being in the unsupported position. The second radius 190 corresponds to the base member 112 being in the elevated position and the adjustable wheel assembly 124 being in the supported position. The difference between the two radiuses 188, 190 is equal to the distance that the base member 112 is elevated above the ground 198.

Because the second radius 190 is longer than the first radius 188, the rotating cam 152 will elevate the base member 112 as the edges of the cam 152 slide along the surface 194 of the clevis 164. The first radius 188 and the second radius 190 establish the distance between the axle 156, on which the cam 152 pivots, and the surface 194 of the clevis 164. Thus, as the base member 112 and the clevis 164 are displaced further from the axle 156, the base member will elevate above the playing surface 128.

Because the shape of the cam 152 will control the movement of the base member 112 relative to the wheels 132, the shape of the cam 152 can be varied to provide a wide range of movement. For example, the length difference between the first radius 188 and the second radius 190 may be increased or decreased to change the lifting characteristics of the base member 112. If the difference between the two radiuses 188, 190 is increased then the base member 112 will elevate higher off of the playing surface 128. Conversely, if the difference between the two radiuses 188, 190 is decreased the elevation 198 will be smaller.

Additionally, the rate of change between the radiuses 188, 190 will control the responsiveness of the base member 112 to the cam 152 and the lever 136. For example, if the rate of change between the radiuses 188, 190 is increased, then a small movement of the lever 136 will raise the base member 112 substantially. Conversely, if the rate of change between the radiuses 188, 190 is decreased, then a large movement of a lever 136 will be required to elevate the base member 112.

Furthermore, the cam 152 may have a plurality of stable locations, such that an increase of force is required to rotate the cam in either direction. The stable locations may be produced by various geometries of the cam 136. For example, the cam 152 may have various flat locations which will align with the surface 194 of the clevis 164. The flat locations will have a locking-type effect on the lever 136. As the flat location aligns with the surface 194 of the clevis 164, the lever 136 will have an increased resistance to rotation in either direction from the flat location alignment.

Thus, flat locations may be placed in the cam 152 corresponding to the lowered position and the elevated position, such that the level 136 locks to the two positions. A variation of the flat location embodiment may be accomplished by replacing the flat location with a notch and protrusion, where the protrusion locks into the notch at determine orientations.

The cam 152 may also incorporate a stop to limit the travel of the cam 152 to a determine range. A stop may be implemented to prevent the lever from striking the pole 116 when lowering the base member 112. Additionally, a stop may be implemented to prevent the cam 152 from striking the playing surface 128 when the base member 112 is in the elevated position and when the system 100 is being moved. The stops may be a protrusion on the cam 152 that butt against an interference structure in the clevis 164 or on the base member 112. As a stop contacts an interference structure, the cam 152 and the lever 136 can no longer rotate. Thus, stops may control the motion of the lever 136.

While the cam 152 may have many geometries and features, generally the cam 152 is a mechanism that is pivotally attached to the axle 156 of the wheel 132. The cam 152 is operable by a lever 136 attached to the cam 152. As the cam 152 rotates, the varying radiuses 188, 190 will vertically 4 displace the clevis 164 or the base member 112. The vertical 4 displacement of the base member 112 will bring the wheels 132 into supported contact with the playing surface 128. The basketball goal system 100 may then be transported to the desired location on the playing surface 128.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A portable basketball goal system comprising:

a support structure for supporting a basketball goal above a playing surface;

a base member connectable to the support structure, wherein the base member has an elevated position above the playing surface and a lowered position substantially in contact with the playing surface; and a wheel assembly coupled to the base member comprising:

a wheel having an axle;

a cam pivotable about the axle for transitioning the base member from the lowered position to the elevated position; and an adjustment member operably attached to the cam for pivoting the cam;

wherein the adjustable wheel assembly further comprises a clevis; and wherein the clevis has a following member.

2. The portable basketball goal system as in claim 1, wherein the cam biases the follower member to transition the base member from the supported position to the unsupported position.

3. A portable basketball goal system comprising:

a support structure for supporting a basketball goal above a playing surface;

a base member connectable to the support structure, wherein the base member has an elevated position above the playing surface and a lowered position substantially in contact with the playing surface; and a wheel assembly coupled to the base member comprising:

a wheel having an axle;

a cam pivotable about the axle for transitioning the base member from the lowered position to the elevated position; and an adjustment member operably attached to the cam for pivoting the cam;

wherein the base member further comprises a follower.

4. The portable basketball goal system as in claim 3, wherein the cam and the follower cooperatively function to transition the base member from the lowered position to the elevated position.

5. A portable basketball goal system comprising:

a pole for supporting a basketball goal above a playing surface;

a base member for receiving the pole, such that the pole is maintained in a generally upward direction, and wherein the base member has an elevated position and a lowered position;

a clevis pivotally attached to the base member;

a wheel having an axle, wherein the axle is rotatably and slidably coupled to the clevis;

a cam pivotable about the axle to transition the base member to the lowered position and the elevated position; and an adjustment member attached to the cam, wherein the adjustment member pivots the cam;

wherein the clevis further comprises at least one slot for maintaining the axle.

6. The portable basketball goal system as in claim 5, wherein the axle is rotably and slidably positioned within the slot.

7. The portable basketball goal system as in claim 5, wherein the clevis has a follower member.

8. The portable basketball goal system as in claim 7, wherein the cam biases the follower member to transition the base member from the supported position to the unsupported position.

9. The portable basketball goal system as in claim 5, wherein the clevis is pivotably attached to the base member.

10. The portable basketball goal system as in claim 5, further comprising more than one cam.

11. The portable basketball goal system as in claim 10, wherein the cams pivot coaxially.

12. The portable basketball goal system as in claim 5, wherein the base member further comprises a second wheel located at a spaced distance from the wheel.

13. The portable basketball goal system as in claim 12, wherein the second set of wheels are fixedly attached to the base member.

14. The portable basketball goal system as in claim 13, wherein, in the elevated position, the second set of wheels are in contact with the playing surface.

15. The portable basketball goal system as in claim 5, wherein the adjustment member is a lever.

16. The portable basketball goal system as in claim 5, wherein the adjustment member is a foot pedal.

17. The portable basketball goal system as in claim 5, wherein the cam has at least one stop to restrict the range of pivotal motion of the cam.

18. The portable basketball goal system as in claim 5, wherein the geometry of the cam has at least one stable position.

19. The portable basketball goal system as in claim 5, wherein the wheel is positioned under the support structure.

20. The portable basketball goal system as in claim 5, wherein the base member further comprises a follower.

21. The portable basketball goal system as in claim 20, wherein the cam and the follower cooperatively function to transition the base member from the lowered position to the elevated position.

22. A portable basketball goal system comprising:

a support structure for supporting a basketball goal above a playing surface;

a base being sized and configured to maintain the support structure in a generally upward direction;

a bracket connected to the base;

a wheel assembly connected to the bracket, the wheel assembly including an axle with one or more wheels attached to the axle, the wheel assembly movable relative to the base between a first position in which the base is held in a generally stationary position relative to the playing surface and a second position in which the base is movable relative to the playing surface; and a cam connected to the axle of the wheel assembly, the cam being sized and configured to move the wheel assembly between the first position and the second position.

23. The portable basketball goal system as in claim 22, wherein the bracket is pivotally attached to the base to allow the wheel assembly to turn relative to the base.

24. The portable basketball goal system as in claim 22, further comprising one or more elongated openings in the bracket and the axle of the wheel assembly being disposed within the one or more elongated openings; wherein the axle of the wheel assembly moves within the one or more elongated openings when the wheel assembly is moved between the first position and the second position.

25. The portable basketball goal system as in claim 22, further comprising an outer surface of the cam that is sized and configured to contact a portion of the bracket as the wheel assembly is moved between the first position and the second position.

26. The portable basketball goal system as in claim 22, further comprising an outer surface of the cam that is sized and configured to contact a portion of the base as the wheel assembly is moved between the first position and the second position.

27. The portable basketball goal system as in claim 22, further comprising a first radius of curvature of the cam and a second radius of curvature of the cam, the first radius of curvature and the second radius of curvature being sized and configured to move the wheel assembly between the first position and the second position.

28. The portable basketball goal system as in claim 22, further comprising a handle attached to the cam; wherein movement of the handle moves the wheel assembly between the first position and the second position.

29. The portable basketball goal system as in claim 22, further comprising a second wheel assembly attached to the base.

30. The portable basketball goal system as in claim 22, wherein at least a portion of the base engages the playing surface in the first position to hold the portable basketball goal system in a generally stationary position.

31. A portable basketball goal system comprising:

a support structure for supporting a basketball goal above a playing surface;

a base being sized and configured to maintain the support structure in a generally upward direction;

a bracket connected to the base, the bracket including one or more elongated openings;

a wheel assembly including an axle with one or more wheels attached to the axle, the axle being disposed within the one or more elongated openings in the bracket, the wheel assembly movable relative to the base between a first position in which the base is held in a generally stationary position relative to the playing surface and a second position in which the base is movable relative to the playing surface; and a cam connected to the axle of the wheel assembly, the cam being sized and configured to move the wheel assembly between the first position and the second position.

32. The portable basketball goal system as in claim 31, wherein the bracket is pivotally attached to the base to allow the wheel assembly to turn relative to the base.

33. The portable basketball goal system as in claim 31, wherein the axle of the wheel assembly moves within the one or more elongated openings when the wheel assembly is moved between the first position and the second position.

34. The portable basketball goal system as in claim 31, further comprising an outer surface of the cam that is sized and configured to contact a portion of the bracket as the wheel assembly is moved between the first position and the second position.

35. The portable basketball goal system as in claim 31, further comprising an outer surface of the cam that is sized and configured to contact a portion of the base as the wheel assembly is moved between the first position and the second position.

36. The portable basketball goal system as in claim 31, further comprising a first radius of curvature of the cam and a second radius of curvature of the cam, the first radius of curvature and the second radius of curvature being sized and configured to move the wheel assembly between the first position and the second position.

37. The portable basketball goal system as in claim 31, further comprising a handle attached to the cam; wherein movement of the handle moves the wheel assembly between the first position and the second position.

38. The portable basketball goal system as in claim 31, further comprising a second wheel assembly attached to the base.

39. The portable basketball goal system as in claim 31, further comprising a second cam connected to the axle of the wheel assembly.

* * * * *

UNITED STATES PATENT AND TRADEMARK OFFICE

CERTIFICATE OF CORRECTION

PATENT NO. : 6,656,065 B2
DATED : December 2, 2003
INVENTOR(S) : S. Curtis Nye

It is certified that error appears in the above-identified patent and that said Letters Patent is hereby corrected as shown below:

Column 1,
Line 8, insert -- to -- after "relates"
Line 43, insert -- , -- after "selective"
Line 59, change "massive" to -- mass of --
Line 66, insert -- the -- after "in"

Column 2,
Line 13, change "that" to -- the --
Line 13, insert -- and -- after "morning"

Column 6,
Line 54, change "position" to -- positioned --

Column 7,
Line 4, insert -- a -- after "include"

Signed and Sealed this

Third Day of August, 2004

JON W. DUDAS
*Acting Director of the United States Patent and Trademark Office*